US006351541B1

(12) United States Patent
Zinserling

(10) Patent No.: US 6,351,541 B1
(45) Date of Patent: Feb. 26, 2002

(54) ELECTROSTATIC TRANSDUCER

(75) Inventor: Bert Zinserling, Bad Nauheim (DE)

(73) Assignee: Sennheiser Electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 08/819,327

(22) Filed: Mar. 18, 1997

(30) Foreign Application Priority Data

Mar. 29, 1996 (DE) ..... 196 12 481

(51) Int. Cl.[7] ..... H04R 25/00

(52) U.S. Cl. ..... 381/322; 381/191; 381/431; 381/328; 381/380; 381/423; 381/71.7

(58) Field of Search ..... 381/116, 328, 381/322, 173, 190, 191, 345, 338, 386, 423, FOR 146, FOR 1, 71.7, 408, 335, 336, 398, 184, 430, 431; 181/199, 153, 154

(56) References Cited

U.S. PATENT DOCUMENTS

| | | | | |
|---|---|---|---|---|
| 2,440,078 A | * | 8/1948 | Devine | |
| 3,892,927 A | * | 7/1975 | Lindenberg | 179/111 R |
| 3,918,551 A | * | 11/1975 | Rizo-Patron | 181/144 |
| 4,289,936 A | | 9/1981 | Civitello | |
| 4,440,982 A | * | 4/1984 | Kaanders | 179/107 R |
| 4,753,317 A | * | 6/1988 | Flaanders | 181/144 |
| 4,836,326 A | * | 6/1989 | Wehner | 181/144 |
| 5,208,868 A | * | 5/1993 | Sapiejewski | 381/183 |
| 5,214,709 A | | 5/1993 | Ribic | |
| 5,471,018 A | * | 11/1995 | Nieuwendijk | |
| 5,570,428 A | * | 10/1996 | Madaffari et al. | 381/191 |
| 5,664,020 A | * | 9/1997 | Goldfarb et al. | 381/89 |
| 6,005,957 A | * | 12/1999 | Meeks | 381/386 |

FOREIGN PATENT DOCUMENTS

| | | |
|---|---|---|
| DE | 2 114 163 | 9/1972 |
| DE | 26 54 622 | 9/1978 |
| DE | 30 47 834 | 9/1981 |
| EP | 533 284 | 3/1993 |
| GB | 2 200 013 | 7/1988 |
| WO | WO 95/34185 | 12/1995 |

* cited by examiner

*Primary Examiner*—Binh Tieu
*Assistant Examiner*—Dionne Harvey
(74) *Attorney, Agent, or Firm*—Merchant & Gould P.C.

(57) ABSTRACT

An electrostatic transducer with a tubular housing in which a planar transducer membrane is arranged, whereby the transducer membrane is arranged at an angle other than 0° to the cross-section of the housing. Due to the angular arrangement of the transducer membrane to the cross-section of the housing, the transducer membrane is arranged to the ear drum in an anti-parallel fashion, which results in a minimization of the resonances inside the ear passage. Apart from that the angular arrangement of the membrane to the cross-section of the housing causes the surface of the membrane to be raised to the cross-section of the housing, which results in higher acoustic pressures and a lower dominant resonance of the system.

7 Claims, 2 Drawing Sheets

ELECTROSTATIC TRANSDUCER

FIELD OF THE INVENTION

The invention relates to an electrostatic transducer or an ear piece with such an electrostatic transducer for use in high quality hearing aid transducers and/or HiFi earphones.

BACKGROUND OF THE INVENTION

Electrostatic transducers have in principle been known for a long time. Contrary to electrodynamic transducers whose membrane is actuated cyclically by an oscillation coil, the propulsion of the membrane in the electrostatic transducer takes place over the whole surface. This is achieved by mounting a very thin conductive foil between two surface electrodes for use as a sound producing membrane which reacts to the slightest variations in the applied voltage of the audio frequency.

A thus activated membrane follows the audio signal with extraordinary accuracy. It reacts so fast that the playback is nearly free from intermodulation distortions, phase errors and intermodulation products.

Besides that, the low mass of the membrane also contributes substantially to the detailed definition which is not attained with an electrodynamic transducer because the transducer membrane of an electrodynamic transducer is many times thicker than the membrane of an electrostatic transducer which can, for instance, dispose of a transducer membrane with a thickness of around 1 $\mu$m.

Contrary to the electrodynamic transducer, an electrostatic transducer does, however, require a relatively high expenditure of technology, since the smallest tolerances must be kept during its production and the dimensional accuracy requires relatively high expenses during the production. Due to its higher costs, the electrostatic transducer is usually only applied in the more upmarket areas of HiFi and HighEnd.

The use of electrostatic transducers has hitherto not been possible for so-called Intra-Concha earphones, i.e. ear pieces which have a transducer and are inserted into the outer auditory passage because no transducer surfaces big enough to supply the necessary acoustic signals in the required quality can be produced due to the small diameters of the auditory passage.

SUMMARY OF THE INVENTION

The object of the invention is therefore to develop an electrostatic transducer which can also be used for ear pieces for "Intra-Concha earphones", such as hearing aids. Apart from that, the resonances in the ear passage should be minimised.

According to the invention the task is solved with the help of an electrostatic transducer with a tubular housing in which a planar transducer membrane is arranged, whereby the transducer membrane is arranged at an angle other than 0° to the cross-section of the housing. Due to the angular arrangement of the transducer membrane to the cross-section of the housing, the transducer membrane is arranged to the ear drum in an anti-parallel fashion, which results in a minimisation of the resonances inside the ear passage. Moreover the angular arrangement of the membrane to the cross-section of the housing causes the surface of the membrane to be raised relative to the cross section of the housing, which results in higher acoustic pressures and a lower dominant resonance of the system. Further advantages are described in the subclaims.

The measures according to the invention result in a high transmission quality of the electrostatic transducer and readily permit a use of the electrostatic transducer in a hearing aid or for an Intra-Concha earphone for HiFi purposes.

The angle of the transducer membrane to the cross section of the housing is preferably about 30 to 90 degrees, preferably around 60 degrees. If the membrane and the transducer electrodes that surround it diagonally intersect a tubular or circular cylindrical housing, this automatically results in a transducer membrane with an elliptical surface.

For damping purposes it is advantageous to arrange damping material such as fleeces, fabrics, materials, wadding or other damping materials in the housing on that side of the membrane that is turned away from the ear and/-or that is facing the ear.

BRIEF DESCRIPTION OF THE DRAWINGS

The invention is hereafter explained in more detail by the drawings of an example of an embodiment. In the drawing.

DETAILED DESCRIPTION OF PREFERRED EMBODIMENTS

Figures 1, 2:
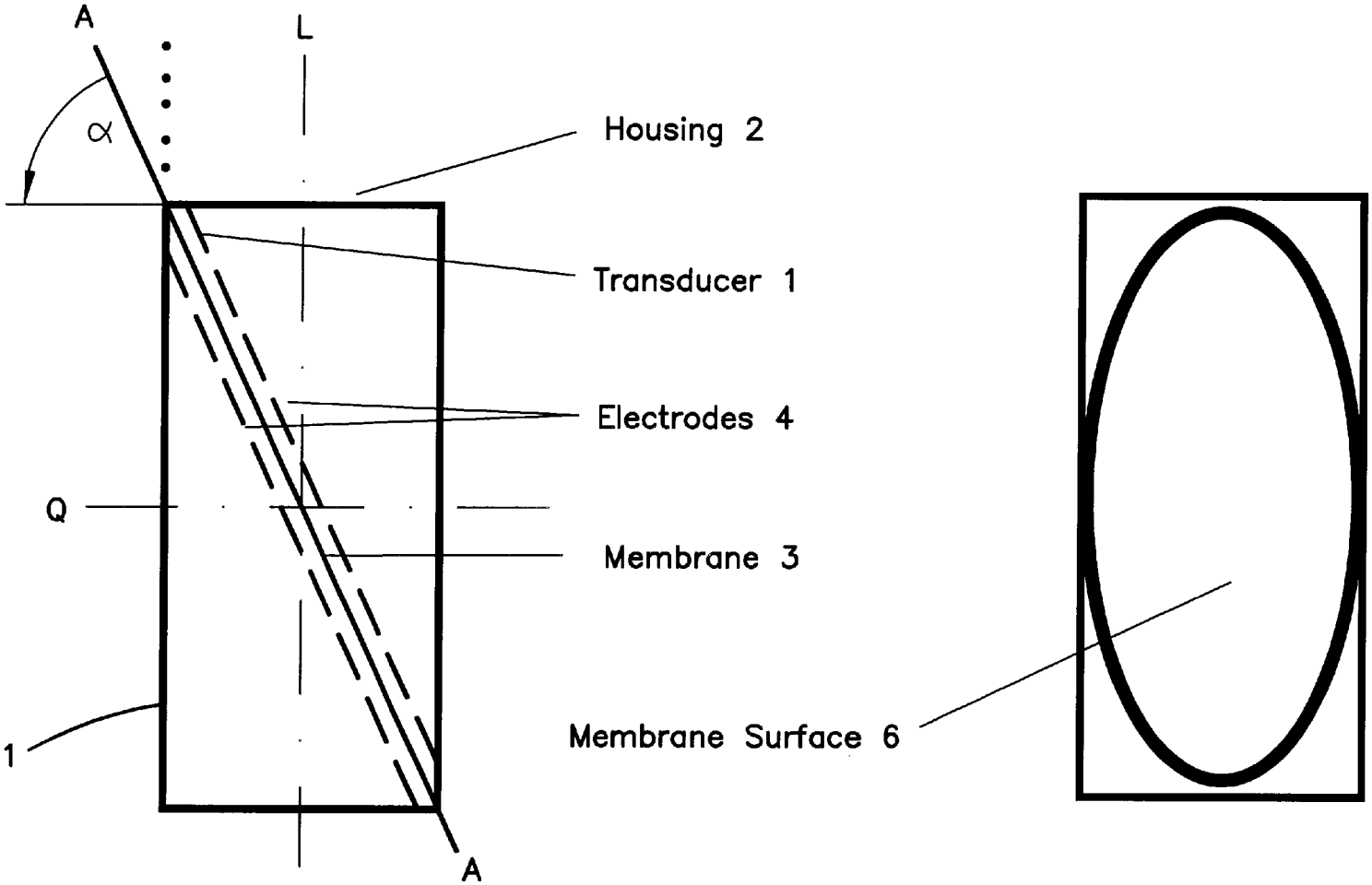
FIG. 1 represents a sectional view of an electrostatic ear piece
FIG. 2 represents a section along the line A—A in FIG.1

FIG. 1 shows a longitudinal sectional view of an ear piece 11 providing a housing 2 which has a cylindrical shape in the illustrated example, whereby in the illustrated example the longitudinal axis is identified with the reference L and the cross sectional surface of the housing with Q.

Inside the housing 2 a membrane 3 is diagonally arranged cutting the cross sectional surface Q in an angle of approximately 60 degrees in the illustrated example. On both sides of the membrane 3 electrodes 4 are arranged.

The quasi diagonal arrangement of the transducer membrane 3 results in an elliptic membrane surface 6, as illustrated in FIG. 2. Due to the angular arrangement of the membrane 3 inside of the transducer housing 2, the membrane surface is substantially raised relative to the cross sectional surface of the cylindrical housing, enabling higher acoustic pressures and causing the transducer to exhibit a lower dominant resonance.

In comparison to a solution where the transducer membrane runs along the cross section of the housing, a reduction in the natural resonances of the membrane is achieved and, apart from that, resonances inside the ear passage are minimised by the antiparallel arrangement of the transducer to the ear drum.

Figure 1A:
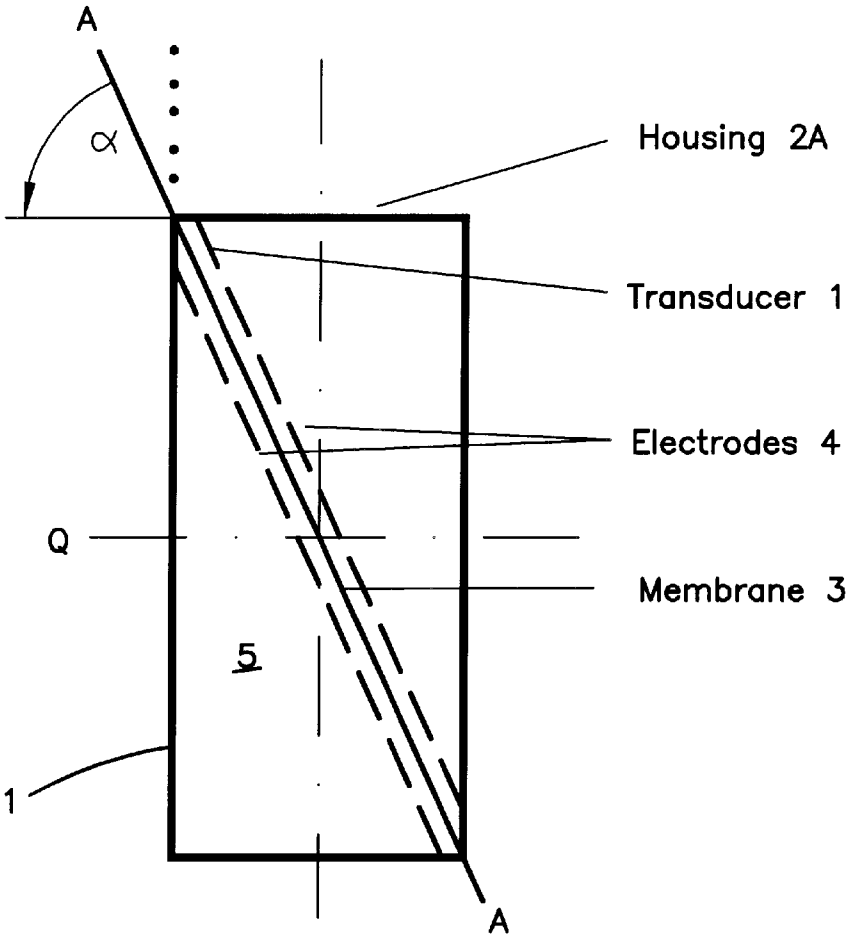
FIG. 1A represents a sectional view of an electrostatic ear piece where the housing has an elliptical shape.

FIG. 1A represent a sectional view of a electrostatic ear piece where the housing 2A has an elliptical shape.

For the damping of the membrane dominant resonance it is possible to insert damping means 5 such as fleeces, fabrics, materials and wadding inside the housing 2, namely on that side of the membrane that faces away from the ear and/or that faces toward the ear.

In the illustrated example, the flexibility of the membrane 3 is higher than the flexibility of the ear drum. Thus the membrane has a low tuning.

In order to be able to comply with prescribed safety measures such as in VDE-DIN 0860, the signal voltage is lower than 34 volt.

The membrane is provided with a constant load, which can be achieved with an electret or a ferro dielectric or another polarization voltage that is applied from outside.

With the illustrated transducer a high quality hearing aid or ear piece or any other audio playback device can be produced, the playback quality being recognizably better than with a transducer with a magnetic or electrodynamic principle.

What is claimed is:

1. Electrostatic transducer comprising:

a tubular housing with a longitudinal axis and a cross-sectional plane perpendicular to the longitudinal axis; and a planar electrostatic transducer membrane having electrodes disposed thereon, the planer electrostatic transducer being inclined with respect to the cross-sectional plane; wherein the cross-sectional plane of the tubular housing is substantially circular and the transducer membrane is shaped as an ellipse, whereby the surface area of the membrane is larger than the surface area of the cross-sectional plane of the tubular housing.

2. The electrostatic transducer according to claim 1, further comprising a fixed electrode on each side of the transducer membrane, whereby the electrostatic transducer functions according to the push-pull principle.

3. The electrostatic transducer according to claim 1, wherein the transducer membrane intersects the tubular housing substantially diagonally.

4. The electrostatic transducer according to claim 1, wherein an angle between the transducer membrane and the cross-sectional plane is 60°.

5. The electrostatic transducer according to claim 1, further comprising damping means within the housing.

6. The electrostatic transducer according to claim 1, wherein a compliance of the transducer membrane is higher than a compliance of an ear drum.

7. An ear phone comprising:

an electrostatic transducer comprising a tubular housing with a longitudinal axis and a cross-sectional plane perpendicular to the longitudinal axis, and a planar electrostatic transducer membrane having electrodes disposed thereon, the planer electrostatic transducer membrane being inclined with respect to the cross-sectional plane; wherein the cross-sectional plane of the tubular housing is substantially circular and the electrostatic transducer membrane is shaped as an ellipse, whereby the surface area of the membrane is larger than the surface area of the cross-sectional plane of the tubular housing.

* * * * *